United States Patent [19]

Aoki et al.

[11] Patent Number: 4,680,246

[45] Date of Patent: Jul. 14, 1987

[54] METHOD FOR PRODUCING AN ELECTROPHOTOGRAPHIC ELEMENT

[75] Inventors: Motohisa Aoki; Hironobu Iwanaga, both of Tokyo, Japan

[73] Assignee: Mitsubishi Chemical Industries Limited, Tokyo, Japan

[21] Appl. No.: 873,451

[22] Filed: Jun. 6, 1986

Related U.S. Application Data

[60] Continuation of Ser. No. 709,902, Mar. 8, 1985, abandoned, which is a division of Ser. No. 508,038, Jun. 27, 1983, abandoned.

[30] Foreign Application Priority Data

Jun. 29, 1982 [JP] Japan ..... 57-112423

[51] Int. Cl.[4] ..... G03G 5/00

[52] U.S. Cl. ..... 430/133; 427/74; 430/134; 430/935; 118/500

[58] Field of Search ..... 430/133, 134, 935; 118/500; 427/74

[56] References Cited

U.S. PATENT DOCUMENTS

| | | | |
|---|---|---|---|
| 2,808,344 | 10/1957 | Kaulen et al. | 430/935 X |
| 3,046,156 | 7/1962 | Kaulen | 430/935 X |
| 3,085,825 | 4/1963 | Cauchois et al. | 294/86.15 |
| 3,185,131 | 5/1965 | Manning | 118/406 X |
| 3,253,854 | 5/1966 | Hollander, Jr. | 269/22 X |
| 3,418,150 | 12/1968 | Jones et al. | 118/505 X |
| 3,780,492 | 12/1973 | Corderoy | 294/93 X |
| 3,849,128 | 11/1974 | Ihara | 430/133 X |
| 3,945,486 | 3/1976 | Cooper | 294/93 X |
| 4,253,694 | 3/1981 | Walter et al. | 294/93 |
| 4,328,267 | 5/1982 | Matsuo et al. | 427/430.1 X |

FOREIGN PATENT DOCUMENTS

| | | | |
|---|---|---|---|
| 1070081 | 11/1959 | Fed. Rep. of Germany . | |
| 2419774 | 1/1974 | Fed. Rep. of Germany | 430/133 |
| 55-126252 | 9/1980 | Japan | 430/133 |
| 57-5047 | 1/1982 | Japan | 427/430.1 |
| 57-5048 | 1/1982 | Japan | 427/430.1 |
| 58-11945 | 1/1983 | Japan | 430/133 |
| 213270 | of 1941 | Switzerland | 427/430 |

*Primary Examiner*—John D. Smith

*Attorney, Agent, or Firm*—Oblon, Fisher, Spivak, McClelland & Maier

[57] ABSTRACT

A method for holding a hollow cylindrical body without a bottom without contacting the outside surface thereof and immersing the body in a liquid with which the outside surface of the cylindrical body is to be coated and preventing the liquid from contacting the inside wall of the cylindrical body. The method utilizes a device which includes device an inflatable elastic membrane which tightly contacts the inside wall of the cylindrical body so as to hold the body when it is inflated by supply of compressed fluid. The process for producing an electrophotographic element includes the steps of holding the hollow cylindrical body without a bottom, immersing the cylindrical body in a liquid containing a photosensitive material and separating the cylindrical body from the liquid to form a uniform photosensitive layer only on the outside surface thereof.

1 Claim, 3 Drawing Figures

METHOD FOR PRODUCING AN ELECTROPHOTOGRAPHIC ELEMENT

This application is a continuation of application Ser. No. 709,902, filed Mar. 8, 1985, now abandoned, which is a division of application Ser. No. 508,038, filed June 27, 1983, now abandoned.

Field of the Invention

This invention relates to a method for producing an electrophotographic element by holding and releasing a hollow cylindrical body by simple operation without touching the outside surface thereof. More particularly, the invention relates to a method for holding a hollow cylindrical body and immersing it in a liquid so that the entire outside surface of the cylindrical body can come in contact with the liquid but the inside wall of the cylindrical body is prevented from coming in contact with the liquid.

The method of this invention is especially useful in a case where a photosensitive layer is formed on the surface of a drum by applying a photosensitive material thereon as in the manufacture of electrophotographic apparatuses, although the use of the method is not limited to such application.

BACKGROUND OF THE INVENTION

One method for forming a photosensitive layer on a drum surface is by immersing the drum in a solution of a photosensitive material by lowering it into the solution. In this method, however, no coating is formed at that part of the drum where the drum is grasped, that is, at the contact points between the drum and the holding means. Therefore the drum must be grasped at parts other than the outside surface. Also, if the photosensitive material is applied onto the inside wall of the hollow cylindrical body, there is a waste of valuable photosensitive material. Therefore, the inside wall of the cylindrical body should be prevented from contacting the solution of photosensitive material. No simple device for holding a hollow cylindrical body which satisfies the above-mentioned requirements has been heretofore known.

SUMMARY OF THE INVENTION

According to this invention, there is provided a method for producing an electrophotographic element by holding a hollow cylindrical body and immersing it in a liquid so that only the outside surface thereof comes into contact with the liquid and which includes: (a) a holding method utilizing a mechanism comprising at least one fluid-tight inflatable member which is tightly pressed onto the inside wall of a cylindrical body to be held when a compressed fluid is introduced therein; (b) supporting means secured to the holding mechanism; (c) a mechanism for introducing a fluid into the fluid-tight inflatable member of the holding mechanism and withdrawing it therefrom; and (d) a mechanism for supporting and suspending the supporting means. The method includes the steps of holding a hollow cylindrical body without a bottom; immersing said cylindrical body in a liquid containing a photosensitive material; and separating said cylindrical body from said liquid to form a uniform photosensitive layer only on the outside surface thereof.

In the method of this invention, it is convenient to use a hollow rod as the supporting means which functions as a part of the mechanism for introducing a fluid into the holding mechanism with the inflatable member. However, a solid rod and separate tube means communicating the holding mechanism and a fluid source can be used instead of a hollow rod.

The device utilized in the method of this invention serves to hold a hollow cylindrical body by means of holding means which engages with the inside wall of the cylindrical body by frictional force. Theoretically the fluid for inflating the inflatable member may be a liquid, but practically it is a gas, usually air. If a hollow cylindrical body is held by the device in accordance with this invention and vertically lowered into a liquid, the entire outside surface of the cylindrical body is able to contact the liquid, since there is no part which is covered by the holding means. Also the inside space at the lower end of the cylindrical body is filled with the ambient gas and the confined gas prevents the liquid from entering thereinto by virtue of its pressure, and thus nearly all the inside surface of the cylindrical body is prevented from coming into contact with the liquid.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
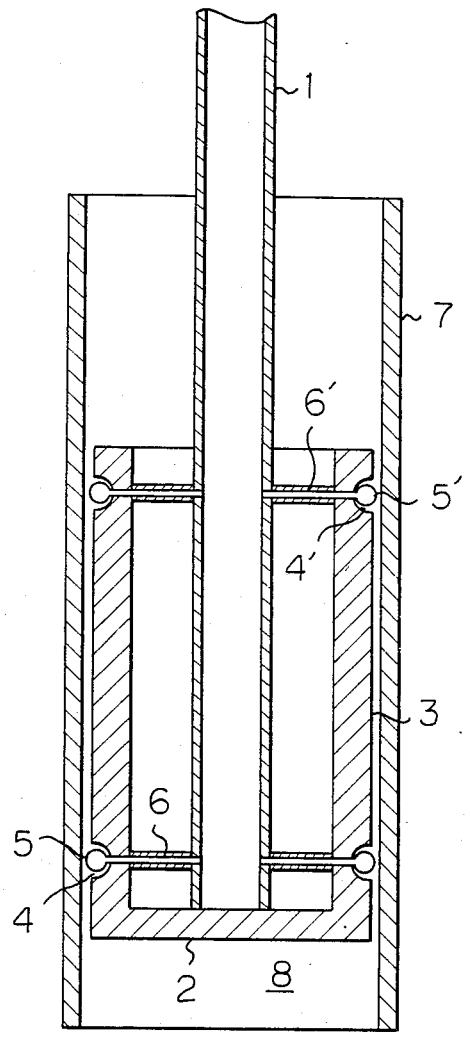
FIGS. 1, 2 and 3 are schematic elevational cross-sections representing the concepts of three preferred embodiments of this invention, respectively.

In FIG. 1, the device by which the method is practiced comprises a hollow rod 1, a hollow cylindrical member 3 having a bottom plate 2, whereby the hollow rod is secured to the hollow cylindrical member. The hollow cylindrical member 3 is provided with two circumferential grooves 4 and 4', which are positioned adjacent opposite ends of the hollow cylindrical member 3. The outer diameter of the hollow cylindrical member is slightly smaller than the inside diameter of a hollow cylindrical body 7, that is, a drum to be held by the device, so that the former can be freely inserted in the latter. Within each groove is fitted an annular tube 5, 5' an elastomeric material, rubber for instance. The tubes 5, 5' are respectively communicated with the hollow rod 1 by means of at least one duct 6, 6'. In FIG. 1, two tubes 5, 5' are shown. The device works, however, even with only one tube, although it is advantageous for the device to be provided with two tubes 5, 5' form the viewpoint of stable vertical support of the cylindrical body. The rod 1 and the cylindrical member 3 may be supported together with suitable detachable means such as a lid or supporting member, which tightly engages with the rod and the cylinder, as explained later in detail.

This device can be constructed by providing at least one nipple in each of the tubes 5, 5' and the rod 1 and connecting the nipple of the tube 1 and the rod with a flexible but non-inflatable duct 6, 6'. Therefore it is convenient for the bottom plate 2 to be detachably secured to the cylindrical member 3.

The thus constructed first embodiment functions as follows. The cylindrical member 3 is inserted into the cylindrical body or drum 7. In the normal state, there is a clearance formed between the cylindrical body 7 and the tubes 5, 5', and the cylindrical member 3 can be freely inserted therein. Thereafter, the tubes 5, 5' are inflated by introducing compressed air therein through the hollow rod 1 and the ducts 6, 6'. The inflated tubes 5, 5' are thus tightly pressed onto the inside wall of the cylindrical body 7 for preventing passage of air between the outer surface of the cylindrical member 3 and the inner wall of the cylindrical body 7. I the tubes 5, 5' are sufficiently pressurized, the device can hold the cylindrical body 7 by virtue of frictional force. In this condition, the cylindrical body 7 is vertically immersed in a liquid and then is vertically raised. Although a space 8 remains under the cylindrical member 3, this is filled with air, so that the liquid is prevented from entering this space when the cylindrical body 7 is dipped in the liquid. Thus almost all the inside surface of the cylindrical body 7 is prevented from contact with the liquid, and only the outside surface is coated.

Figure 2:
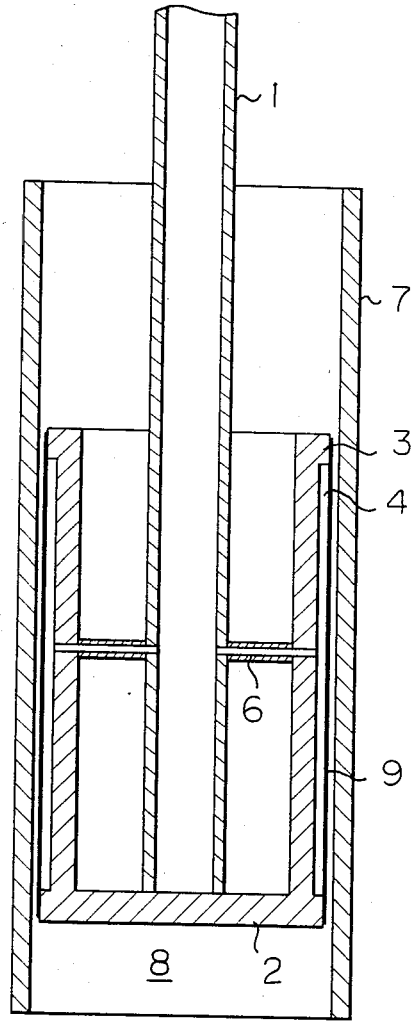

In the embodiment shown in FIG. 1, the cylindrical member 3 has two elastomer tubes 5, 5' fitted in the upper and lower grooves 4, 4'. However, the same effect can be achieved by simply covering the opening of the groove with an elastic membrane, that is, a film of an elastomer. For the purpose of precisely supporting the cylindrical body 7 in the vertical position, it is desirable that the clearance between the cylindrical body 7 and the cylindrical member 3 be as small as possible. In the same sense, it is advantageous for the inflatable holding means to be provided in two places, namely at the upper end and the lower end of the cylindrical member. However, it is possible to replace such means with one large inflatable means. FIG. 2 shows an example of such an embodiment of this invention. A shallow wide circumferential groove 4 is provided on the surface of the cylindrical member 3, said groove 4 covering most of the lateral surface of the cylindrical member, and the opening thereof is covered by an elastomer membrane 9. Of course a life-jacket-like elastomer bag of the shape conforming with the shape of the groove 4 can be employed in stead of the membrane.

Figure 3:
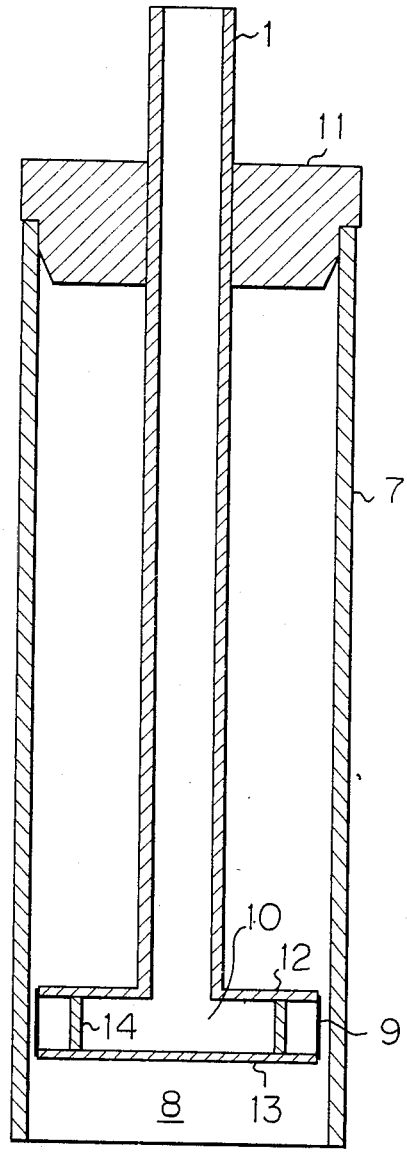

FIG. 3 shows another modification of this invention. A hollow member 10, which is comprised of two parallel disks 12, 13 and a peripheral elastomer membrane 9, is provided at the lower end of the hollow rod 1 so as to communicate therewith. The two parallel disks 12, 13 are supported by pillars 14. Alternately they may be supported by a perforated annular wall. A supporting member 11 is secured at the upper part of the hollow rod 1. This is a thick disk provided with a central through-hole which accommodates the hollow rod and with a recess which fits the opening at the upper end of the cylindrical body 7. The recessed portion has a chamfered or tapered shoulder. When the holding device is inserted into a cylindrical body the chamfered recessed portion acts as a guide and is secured to the upper end of the cylindrical body so that the device and the cylindrical body are fixed tightly in correct alignment. Such a supporting member can also be applied to the devices of FIG. 1 and FIG. 2.

When a cylindrical body is held with the device of FIG. 3, the hollow portion is inserted into the cylindrical body, the supporting member 11 is secured to the upper end of the cylindrical body and the membrane 9 is inflated by supplying compressed air through the hollow rod.

The mechanism for supplying compressed air to the hollow rod and the inflatable member and the mechanism for lowering and raising the device itself are well known among those skilled in the art, and the detailed description thereof is omitted here.

The method and device of this invention has been described above with special reference to preparation of photosensitive drums in the manufacture of electrophotographic apparatuses. However, it is obvious that the device will find useful application in the field of coating and painting in general.

What is claimed is:

1. A process for producing an electrophotographic element, which comprises:

inserting a hollow, cylindrical, solid bottomed closed ended member, having at least one circumferential groove formed in the outside wall thereof and at least one fluid-tight inflatable member mounted within said at least one groove or mounted covering the opening of the groove and communicating a hollow rod with said inflatable member, within a lower portion of a hollow, bottomless cylindrical body having a uniform inner diameter surface portion;

feeding a fluid through said hollow rod to inflate said inflatable member so as to contact said uniform inner diameter surface portion of said bottomless cylindrical body;

immersing said bottomless cylindrical body in a liquid containing a photosensitive material so as to coat an outside surface of said cylindrical body, to confine an ambient gas beneath said solid bottomed closed ended member and to prevent said liquid containing a photosensitive material from entering into the inner space of said cylindrical body except a lowermost portion thereof; and separating said bottomless, cylindrical body from said liquid containing said photosensitive material so as to form a uniform photosensitive layer on said outside surface thereof.

* * * * *